US006031447A

United States Patent [19]

Hofsäss

[11] Patent Number: 6,031,447

[45] Date of Patent: Feb. 29, 2000

[54] SWITCH HAVING A TEMPERATURE-DEPENDENT SWITCHING MECHANISM

[76] Inventor: Marcel Hofsäss, Höfener Strasse 29, 75305 Neuenbürg, Germany

[21] Appl. No.: 09/183,532

[22] Filed: Oct. 30, 1998

[30] Foreign Application Priority Data

Nov. 27, 1997 [DE] Germany ..... 197 52 581

[51] Int. Cl.[7] ..... H01H 37/14; H01H 37/04; H01H 37/54

[52] U.S. Cl. ..... 337/377; 337/343; 337/365; 337/342

[58] Field of Search ..... 337/343, 72, 100, 337/103, 104, 107, 141, 324, 377, 390, 342, 365; 29/622

[56] References Cited

U.S. PATENT DOCUMENTS

| | | | |
|---|---|---|---|
| 4,015,229 | 3/1977 | Senor et al. | 337/107 |
| 4,399,423 | 8/1983 | Nield | 337/102 |
| 4,476,452 | 10/1984 | D'Entremont | 337/102 |
| 4,849,729 | 7/1989 | Hofsass | 337/102 |
| 4,862,132 | 8/1989 | Hollweck | 337/102 |
| 5,023,744 | 6/1991 | Hofsass | 361/26 |
| 5,615,072 | 3/1997 | Hofsass et al. | 361/24 |
| 5,721,525 | 2/1998 | Hofsass | 337/102 |
| 5,745,022 | 4/1998 | Becher et al. . | |
| 5,757,261 | 5/1998 | Becher et al. | 337/377 |

FOREIGN PATENT DOCUMENTS

| | | | |
|---|---|---|---|
| 2113388 | 10/1971 | Germany . | |
| 8617033 | 9/1986 | Germany . | |
| 19527254A1 | 1/1997 | Germany . | |
| 19609310A1 | 9/1997 | Germany . | |
| 356012834A | 2/1981 | Japan | H02K 11/00 |

*Primary Examiner*—Leo P. Picard
*Assistant Examiner*—Anatoly Vortman
*Attorney, Agent, or Firm*—Harness, Dickey & Pierce, P.L.C.

[57] ABSTRACT

A switch has a housing 12 which receives a temperature-dependent switching mechanism 11, a first housing part 15 on whose inner base 25 a first electrode 24 connected to a first external terminal 23 is arranged, and a second housing part 14, closing off the first housing part 15, that has a second electrode 20 connected to a second external terminal 22. The switching mechanism 11 creates, as a function of its temperature, an electrically conducting connection between the first and the second electrode 24, 20. A parallel resistor 33 is arranged in the housing 12, geometrically and electrically between the two electrodes 20, 24.

15 Claims, 2 Drawing Sheets

SWITCH HAVING A TEMPERATURE-DEPENDENT SWITCHING MECHANISM

BACKGROUND OF THE INVENTION

1. Field of the Invention

The present invention relates to a switch having a housing which receives a temperature-dependent switching mechanism and which has a first housing part on whose inner base a first electrode connected to a first external terminal is arranged, and a second housing part, closing off the first housing part, that comprises a second electrode connected to a second external terminal, the switching mechanism creating, as a function of its temperature, an electrically conducting connection between the first and the second electrode.

2. Related Prior Art

A switch of this kind is known from DE 196 09 310 A1.

In the case of the known switch, the first housing part is produced from insulating material, into which the first electrode is embedded as an integral constituent by insert-molding or encapsulation. This first housing part is closed off by a second housing part in the form of a base made of electrically conductive material, the inner side of which acts as a second electrode.

The two electrodes are, so to speak, disk-shaped sheet-metal parts on which extensions which serve as external terminals of the switch are integrally configured. The base part rests on a shoulder of the first housing part, and is retained on the latter by a hot-stamped ring.

Arranged between the two electrodes, in the interior of the housing thus constituted, is an ordinary bimetallic switching mechanism whose spring disk is braced with its rim on the base part and which, below the switching temperature, presses the movable contact element carried by it against an inwardly projecting countercontact on the other electrode. Slipped over the movable contact element, in the usual way, is a bimetallic snap disk which is unstressed below its switching temperature and, when the temperature rises above its switching point, lifts the movable contact element away from the countercontact against the force of the spring disk and thus interrupts the electrical connection between the two external terminals.

The known switch described so far is extremely robust and has very small external dimensions, so that it can be used not only universally but also, in particular, in places where little installation space is available, i.e. for example in the coils of transformers or electric motors. Via the base part, this switch is very well thermally coupled to a device being monitored, so that any rise in the temperature of the device is transferred directly into the interior of the switch and there leads to a corresponding rise in the temperature of the bimetallic snap disk. Switches of this kind are connected in series between the device to be protected and a current source, so that the operating current of the device to be protected flows through the switch, which consequently shuts off that current in the event of an impermissible temperature rise.

It is often necessary, however, to monitor not only the temperature of the device to be protected but also the operating current in terms of maintaining a specific upper limit, in order to be able to shut off the device even before the temperature rise begins. The reason is that with electric motors in particular, it often happens that because of external influences the rotor comes to a stop or rotates only very slowly, which initially leads to a rise in the operating current, which in turn results in an elevation in the temperature of the device. If the elevated current flow already causes the device to shut off, the impermissible temperature rise is entirely avoided, which of course is advantageous.

This protective function of a switch having a temperature-dependent switching mechanism is called "current-dependent" switching, and is accomplished by the fact that a series resistor, through which the operating current of the device to be protected also flows, is connected in series with the switching mechanism. By way of the selection of the resistance value of this series resistor and its thermal coupling to the switch, a specific current flow through the switch and thus through the series resistor leads to the generation of a specific quantity of heat which in turn heats up the switch and thus the bimetallic snap disk in defined fashion. The resistance can thus be used to predefine an upper limit for the operating current. If the operating current exceeds that value, the heat generated in the series resistor heats the bimetallic snap disk above its switching temperature, so that the switch opens even before the device to be protected has heated up impermissibly.

A switch of this kind is known from DE 43 36 564 A1. This switch comprises first of all an encapsulated bimetallic switching mechanism which is housed in a two-part metal housing as known, for example, from DE 21 21 802 A1.

This encapsulated switch is then arranged on a ceramic support on which a thick-film resistor, which is connected via conductor paths to the conducting lower part of the encapsulated switching mechanism, is present. The other end of the resistor is connected to a solder dot onto which a first connector lead is soldered. The second connector lead is soldered onto the electrically conductive cover part of the encapsulated switching mechanism.

Although the known switch satisfactorily makes possible current-dependent switching and at the same time allows temperature monitoring, it still has a number of disadvantages.

For one, the ceramic support cannot bear mechanical loads: during transport in bulk, hairline cracks occur which can be detected upon acceptance inspection only with a microscope. Soldering the leads onto the ceramic support often causes the conductor paths to detach. These problems require greater outlay in terms of inspection and checking, which correspondingly raises the price of the product. A further disadvantage is the low compressive stability of this design, which is not suitable for incorporation into windings of transformers or electric motors.

On the other hand, these known switches are extensively used because the attachment of a resistor having a defined resistance onto a ceramic support is a well-controlled method; here, for example, thick-film resistors are used.

A further function which is desired in temperature-dependent switches is so-called self-holding, in which when the switching mechanism is open, a residual current flows through a parallel resistor and generates sufficient heat to hold the switching mechanism open. When the switching mechanism is closed, the parallel resistor is bypassed by it, so that it now performs no function. If the switching mechanism opens, however, because either the temperature of the device or the temperature of a series resistor (because of an elevated operating current) has caused the bimetallic snap disk to kick over, the parallel resistor now carries a residual current and consequently generates sufficient heat to hold the switching mechanism open. This prevents the switch from cycling repeatedly: the switch cannot close again after the protected device has cooled down, so that the device cannot once again heat up impermissibly.

In this context, the resistance values of the parallel resistor and, if applicable, the series resistor are chosen so that the series resistor has a very low ohmic value so as to influence the current flow as little as possible, while the parallel resistor has a much higher value in order greatly to restrict the strength of the residual current, i.e. to protect the device from any excessive operating current.

A self-holding function of this kind has also been implemented in the switch known from DE 43 36 564 A1, in which there is provided on the ceramic support a PTC module which is soldered at one end to the second connector lead and at the other end to conductor paths which are connected to the lower part of the encapsulated switching mechanism.

The PTC module is thus arranged electrically in parallel with the two-part encapsulated housing and thus with the temperature-dependent switching mechanism, so that when the switching mechanism is in the closed state, it is bypassed by the latter and when the switching mechanism is in the open state, it heats up.

The self-holding function is also satisfactorily implemented with the known switch, but problems resulting from production engineering can occur if the known switch is not assembled by trained personnel. For example, it is known that the thermal behaviour of PTC modules as expressed in a typical temperature curve is influenced when the PTC modules are soldered, and improper soldering can also result in mechanical damage to the PTC module.

Thus not only is production of the known switch very wage-intensive, but a corresponding rejections rate can also occur when temporary personnel are used.

SUMMARY OF THE INVENTION

In view of the above, it is an object of the present invention to improve the switch mentioned at the outset in such a way that it can be equipped, in a physically simple manner, with at least one further function.

In the case of the switch mentioned at the outset, this object is achieved according to the present invention in that a parallel resistor is arranged in the housing, geometrically and electrically between the two electrodes.

The object underlying the invention is completely achieved in this manner.

Specifically, the inventor of the present application has recognized that it is not necessary to arrange the parallel resistor outside the housing of the switch on a separate support, but rather that it can be placed both electrically and geometrically between the two electrodes. The parallel resistor is thus no longer accessible from the outside, i.e. it is protected from mechanical effects. A further advantage is the fact that separate soldering actions for the parallel resistor, as in the existing art, are not necessary, so that shifts in the temperature curve of a PTC module are avoided.

The inventor of the present application has recognized that the PTC module can still be integrated into the housing of the generic switch, since a PTC module having much smaller dimensions can be used if a two-part metal housing is not present between the parallel resistor and temperature-dependent switching mechanism. All that must be ensured with the PTC module is that it has a height of at least 2 mm so that sufficient space for the electric strength remains between the two electrodes.

In an embodiment, it is preferred if the first housing part is produced from insulating material in which the first electrode is held in lossproof fashion; and if there is provided in the first housing part a pass-through opening which extends from the first to the second electrode and receives a PTC module which is connected, as the parallel resistor, to both electrodes.

The advantage here is that insulation of the PTC module is accomplished, so to speak, automatically; all that is necessary, during production of the new switch, is to place a piece of PTC ceramic into the opening provided, which is already closed off at one end by the integral first electrode. The second electrode is then mounted, so that the opening is also closed off on the second end and contact simultaneously can be made to the PTC module. The new switch can thus altogether be assembled very easily; all that must be provided as a further action in the previous production process for the generic switch is a step in which the PTC module is placed into the opening. As a further amendment, the tool for production of the housing from insulating material must be changed so that the opening is created automatically.

It is preferred in this context if a spring tongue which presses the PTC module against the other electrode is provided on one of the two electrodes.

The advantage with this feature is that secure contact is made between the PTC module and both electrodes; the spring force of the spring tongue prevents excessive mechanical stresses from being exerted on the PTC module.

The new switch eliminates the disadvantages known from the prior art in connection with the soldering of PTC modules; the reason is that the PTC module is neither electrically nor mechanically influenced while it is arranged electrically and geometrically between the two electrodes.

It is further preferred if the first electrode is held in lossproof fashion in the first housing part, by encapsulation or insert-molding, during manufacture of the housing part, in such a way that it is an integral constituent of that housing part; the second housing part preferably being an electrically conducting base part whose inner base acts as the second electrode.

These features have already been realized per se in the switch mentioned at the outset; they make possible a highly compression-resistant, easily produced housing with small dimensions. All that is necessary now is to place the PTC module into the housing part, made of insulating material, into which the first electrode is embedded; the base part is then installed, thus automatically making electrical contact to the PTC module on both sides. In this manner a switch can be produced both with and without self-holding; in the latter case, the placement surface for the PTC module is not occupied. The resulting advantage is that a variety of products with entirely different functions and applications can be run on the same automatic production equipment by simply omitting or adding a component. This was not previously possible in this manner, since the integration of resistors for self-holding always required complex special adaptations or designs.

In an embodiment, it is preferred if the switch comprises a ceramic support which is arranged, facing toward the switching mechanism, on one of the two electrodes, and carries a series resistor whose one end is connected to the electrode and other end to the countercontact for the switching mechanism, the first electrode preferably having a flat surface, facing toward the switching mechanism, on which the ceramic support is attached and to which the series resistor is electrically connected.

This feature is advantageous in terms of design: the well-controlled ceramic technique, on which an easily adjusted series resistor is arranged, is used for the series resistor and its geometrical arrangement. But since in this case there is no longer any need to solder leads onto the ceramic support, and the latter is moreover mechanically protected by the housing, a very thin support can be used, so that the external dimensions of the known switch are changed only insignificantly or not at all.

A flat surface onto which the ceramic support is laid is now used on the first electrode instead of the previous projecting countercontact. Because of the planar contact, the ceramic support experiences almost no mechanical load from the switching mechanism, so that the support, including the series resistor provided on it and the countercontact arranged on it, does not need to have any greater thickness than the countercontact in the switch according to the prior art. This means, however, that the switch can maintain its original dimensions; only the first electrode must have a different shape, since what is to be provided on it instead of the countercontact is a flat surface on which the ceramic support is attached. The ceramic support can, in this context, have a through contact for the series resistor, and can be adhesively mounted onto the flat surface in such a way that the through contact at the same time makes electrical contact with this electrode.

On the other hand, however, it is preferred if the ceramic support has at least one preferably laser-drilled through hole through which it is soldered onto the electrode and the series resistor is electrically connected to the latter.

This feature is advantageous in terms of design, specifically because only one operation is necessary in order to create both the mechanical and the electrical connection. The laser-drilled through holes are created using a secured process in which the ceramic support does not "jump," so that the high rejections rate which repeatedly occurs in the existing art in connection with ceramic supports and their subsequent processing is avoided. In addition, these ceramic supports can be delivered in magazined form rather than in bulk, in order to prevent further damage to the ceramic supports.

It is further preferred if the switching mechanism comprises an electrically conducting spring disk which carries a movable contact element and works against a bimetallic snap disk that sits approximately centeredly on the movable contact element, the spring disk being braced at its rim against the one electrode and pressing the movable contact element against the other electrode when the switching mechanism is below its response temperature.

This feature is also known per se; it makes possible a self-aligning bimetallic switching mechanism in which the bimetallic snap disk is unstressed below its switching temperature, so that the switching temperature cannot shift as a result of mechanical stress. In conjunction with the ceramic support, this results in the further advantage of simple contacting to the series resistor. As already mentioned, the latter is connected at one end to the first electrode and at the other end to a countercontact onto which the spring disk presses the movable contact element, so that the series resistor is connected electrically in series between the first electrode and the spring disk, which in turn is connected to the second electrode, so that a series circuit made up of the series resistor and bimetallic switching mechanism is now arranged between the two external terminals of the switch.

According to the invention, the generic switch can thus on the one hand be equipped with a parallel resistor which is placed into a through hole of the insulating housing and is in contact with the electrodes at both ends; on the other hand there can also be provided, by the ceramic plate, a series resistor which ensures current-dependent switching. The generic switch has thus, in surprisingly simple fashion, been improved in such a way that without extensive changes to its production process, a self-holding function and optionally also current-dependent switching are provided.

Further features and advantages are evident from the description and the appended drawings.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

An embodiment of the invention is shown in the appended drawings and will be explained in more detail in the description below. In the drawings.

DETAILED DESCRIPTION OF A PREFERRED EMBODIMENT

Figure 1:
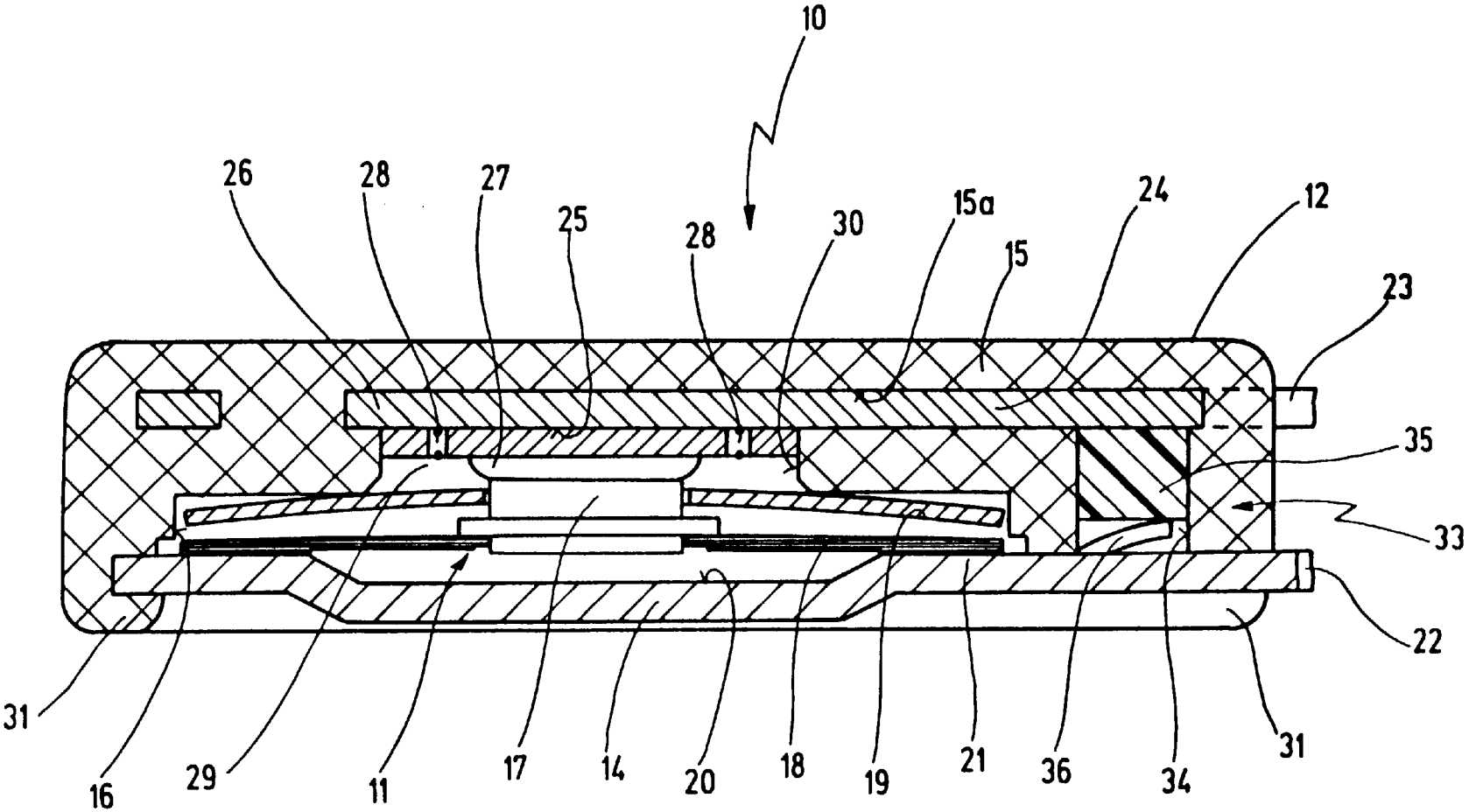
FIG. 1 shows the new switch in a schematic sectioned representation along line I—I of FIG. 2.

FIG. 1 shows, in a schematic side view, a new switch 10 which comprises a temperature-dependent switching mechanism 11 that is arranged in a housing 12.

Housing 12 has an electrically conducting base part 14 and a cup-like cover part 15, made of insulating material, which contains an annular space 16 into which temperature-dependent switching mechanism 11 is placed.

Switching mechanism 11 comprises a movable contact element 17 which is carried by a spring disk 18 and over which a bimetallic snap disk 19 is placed.

The electrically conducting base part 14 constitutes, with its inner side, an electrode 20 against which spring disk 18 braces with its rim 21. The disk-shaped base part 14 transitions integrally into a first external terminal 22 which in the switching state shown is thereby connected in electrically conducting fashion to spring disk 18 and thus to movable contact element 17.

A second external terminal 23 of switch 10 is integrally connected to an insert-molded electrode 24 which is arranged on an inner base 15*a* of cover part 15. Cover part 15 is injection-molded around electrode 24 (also disk-shaped), so that the latter is embedded in lossproof fashion into cover part 15. The arrangement is such that electrode 24 has a flat surface 25, facing toward switching mechanism 11, on which is arranged a ceramic disk 26 which carries an immovable countercontact 27 for movable contact element 17.

Ceramic disk 26 has laser-drilled passages 28 by way of which it is attached, with the aid of solder points 29, to electrode 24. In a manner yet to be described, a series resistor is arranged between solder points 29 and countercontact 27.

As a result of this arrangement, a series circuit made up of switching mechanism 11 and the series resistor is located between the two external terminals 22, 23. In the switching state shown in FIG. 1, bimetallic snap disk 19 is below its switching temperature, so that spring disk 18 presses movable contact 17 against immovable countercontact 27 so that an operating current of an electrical device to be protected, which flows through switching mechanism 10, also flows through and heats up the series resistor. As a function of the resistance of the series resistor and the magnitude of the current flowing, the ohmic heat generated in the series resistor heats up bimetallic snap disk 19, which in FIG. 1 is forceless, so that it lifts movable contact element 17 away from immovable countercontact 27 against the force of spring disk 18, and thus interrupts the current.

It should also be mentioned that electrode 24 faces with its flat surface 25 into an annular space 30 into which ceramic disk 26 is placed after the insert-molding of electrode 24 into cover part 15, whereupon both a mechanical and an electrical connection to electrode 24 is created via solder points 29. Switching mechanism 11 is then placed into annular space 16, whereupon base part 14 is then set in place and is attached via a rim 31 to cover part 15.

Also provided in cup-like cover part 15 besides switching mechanism 11 is a parallel resistor 33 which is arranged geometrically and electrically between the two electrodes 20, 24 and provides for a self-holding function, as has already been described above.

A passthrough opening 34, which extends between the two electrodes 20, 24 and receives a PTC module 35 that is electrically connected at its two ends to electrodes 20, 24, is provided in cover part 15. For this purpose, there is provided on electrode 20 a spring tongue 36 which projects into opening 34 and presses PTC module 35 against the upper electrode 24. The spring force of spring tongue 36 is adjusted in such a way that on the one hand reliable electrical contact with the two electrodes 20, 24 is ensured, but on the other hand the PTC module is not subjected to excessive mechanical load.

Figure 2:
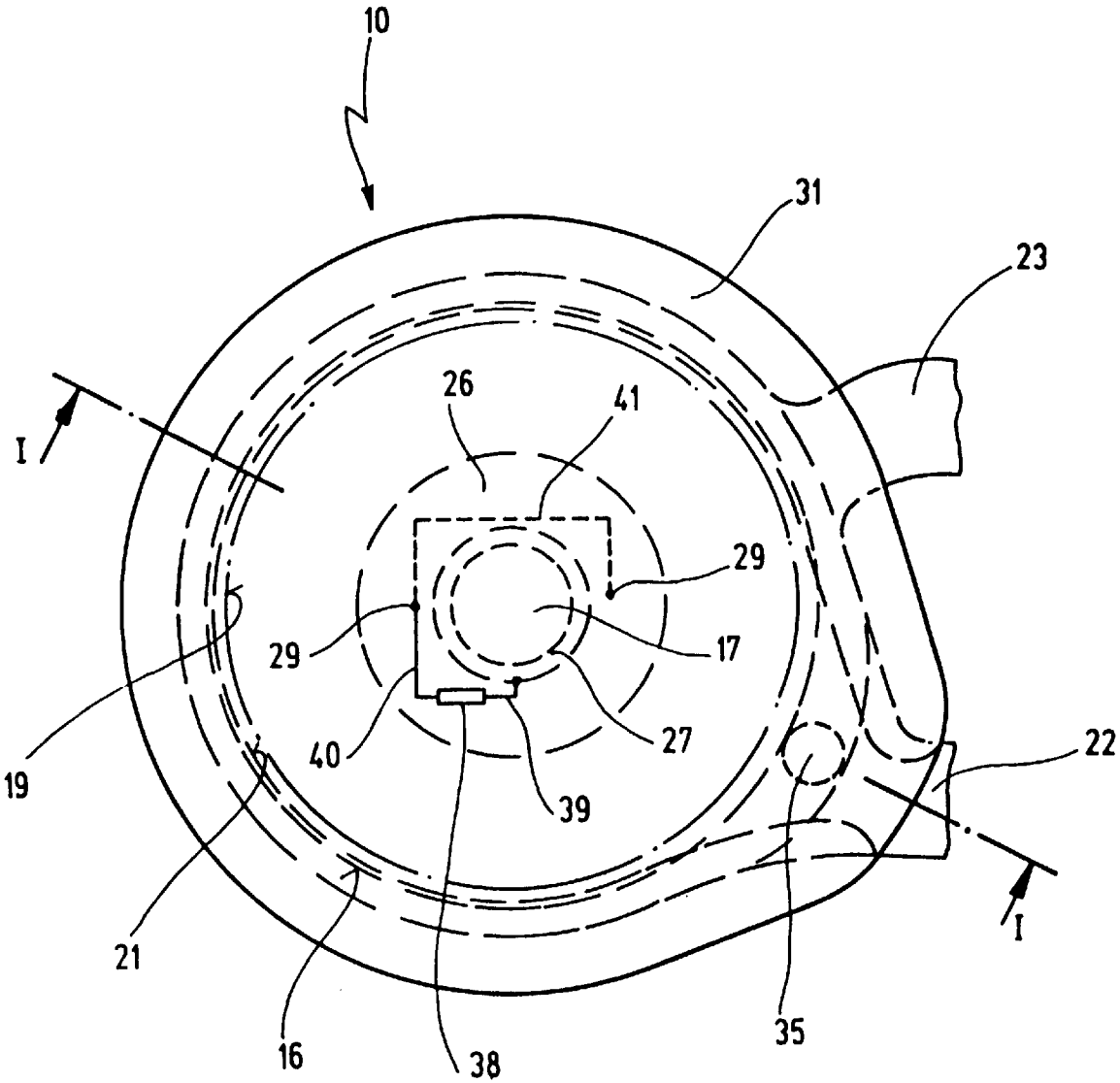
FIG. 2 shows a plan view of the switch of FIG. 1.

FIG. 2 shows a plan view of the switch from FIG. 1, and now also schematically indicates a series resistor 38, which is electrically connected via a conductor path 39 to immovable countercontact 27 and via conductor paths 40 and 41 to solder points 29. Series resistor 38 is an ordinary thick-film resistor which is arranged on ceramic disk 26 using known and well-controlled techniques; its resistance value can be adjusted as required with extreme precision, so that the operating current which causes switch 10 to switch can be accurately preselected.

Also shown schematically is PTC module 35, which lies between the two electrodes 20, 24 that are visible in FIG. 2 as dashed extensions of external terminals 22 and 23, respectively.

Returning to FIG. 1, it should also be noted that series resistor 38 arranged on ceramic disk 26, and parallel resistor 33, are arranged both electrically and geometrically between electrode 24 and switching mechanism 11, or between the two electrodes 20, 24, respectively, in the interior of housing 12.

Therefore, what I claim, is:

1. A switch, having a first and a second external terminal;

a housing comprising a cover part having an inner base, and a base part closing off said cover part, a first electrode being arranged on said inner base and connected to said first external terminal, said base part comprising a second electrode connected to said second external terminal;

a temperature-dependent switching mechanism arranged within said housing and making as a function of temperature an electrically conducting connection between said first and second electrodes; and a parallel resistor arranged within said housing and geometrically and electrically between said first and second electrodes, wherein the cover part is produced from insulating material in which the first electrode is held in lossproof fashion; and there is provided in the cover part a pass-through opening which extends from the first to the second electrode and receives a PTC module which is connected to both electrodes and functions as said parallel resistor.

2. The switch of claim 1, wherein a spring tongue is provided on a first of said two electrodes and presses the PTC module against a second of said two electrodes.

3. The switch of claim 2, wherein the first electrode is held in lossproof fashion in the cover part, by encapsulation or insert-molding, during manufacture of the cover, in such a way that it is an integral constituent of that cover part.

4. The switch of claim 3, wherein the switching mechanism comprises an electrically conducting spring disk which carries a movable contact element and works against a bimetallic snap disk that sits approximately centeredly on the movable contact element, the spring disk being braced at its rim against a first of said two electrodes and pressing the movable contact element against a second of said two electrodes when the switching mechanism is below its response temperature.

5. The switch of claim 2, comprising a ceramic support which is arranged, facing toward the switching mechanism, on a first of the two electrodes, and carrying a series resistor whose one end is connected to said first electrode and whose other end is connected to a countercontact for the switching mechanism.

6. The switch of claim 5, wherein the first electrode has a flat surface, facing toward the switching mechanism, on which the ceramic support is attached and to which the series resistor is electrically connected.

7. The switch of claim 1, comprising a ceramic support which is arranged, facing toward the switching mechanism, on a first of the two electrodes, and carrying a series resistor whose one end is connected to said first electrode and whose other end is connected to a countercontact for the switching mechanism.

8. The switch of claim 7, wherein the first electrode has a flat surface, facing toward the switching mechanism, on which the ceramic support is attached and to which the series resistor is electrically connected.

9. The switch of claim 7, wherein the ceramic support has at least one through hole through which it is soldered onto the electrode and the series resistor is electrically connected to the latter.

10. The switch of claim 9, wherein the through hole is laser-drilled.

11. A switch, having a first and a second external terminal;

a housing comprising a cover part having an inner base, and a base part closing off said cover part, a first electrode being arranged on said inner base and connected to said first external terminal, said base part comprising a second electrode connected to said second external terminal;

a temperature-dependent switching mechanism arranged within said housing and making as a function of temperature an electrically conducting connection between said first and second electrodes; and a parallel resistor arranged within said housing and geometrically and electrically between said first and second electrodes, comprising a ceramic support which is arranged, facing toward the switching mechanism, on a first of the two electrodes, and carrying a series resistor whose one end is connected to said first electrode and whose other end is connected to a countercontact for the switching mechanism.

12. The switch of claim 11, wherein the first electrode has a flat surface, facing toward the switching mechanism, on which the ceramic support is attached and to which the series resistor is electrically connected.

13. The switch of claim 11, wherein the ceramic support has at least one through hole through which it is soldered onto the electrode and the series resistor is electrically connected to the latter.

14. The switch of claim 13, wherein the through hole is laser-drilled.

15. A switch, having a first and a second external terminal;

a housing comprising a cover part having an inner base, and a base part closing off said cover part, a first electrode being arranged on said inner base and connected to said first external terminal, said base part comprising a second electrode connected to said second external terminal;

a temperature-dependent switching mechanism arranged within said housing and making as a function of temperature an electrically conducting connection between said first and second electrodes; and a parallel resistor arranged within said housing and geometrically and electrically between said first and second electrodes, wherein the switching mechanism comprises an electrically conducting spring disk which carries a movable contact element and works against a bimetallic snap disk that sits approximately centeredly on the movable contact element, the spring disk being braced at its rim against a first of said two electrodes and pressing the movable contact element against a second of said two electrodes when the switching mechanism is below its response temperature.

* * * * *